US008870228B2

(12) United States Patent
No et al.

(10) Patent No.: US 8,870,228 B2
(45) Date of Patent: Oct. 28, 2014

(54) BOUND DOCUMENT HAVING BINDING STRIP WITH SPACER

(71) Applicants: Young No, Pittsford, NY (US); Detlef Schulze-Hagenest, Molfsee (DE)

(72) Inventors: Young No, Pittsford, NY (US); Detlef Schulze-Hagenest, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 163 days.

(21) Appl. No.: 13/627,266

(22) Filed: Sep. 26, 2012

(65) Prior Publication Data

US 2014/0084574 A1 Mar. 27, 2014

(51) Int. Cl.
*B42D 1/10* (2006.01)
*B42D 1/04* (2006.01)

(52) U.S. Cl.
USPC ..... 281/21.1; 281/27

(58) Field of Classification Search
CPC ..... B42D 1/006; B42D 1/04; B42D 1/10
USPC ..... 281/21.1, 27, 27.3
See application file for complete search history.

(56) References Cited

U.S. PATENT DOCUMENTS

| | | | | |
|---|---|---|---|---|
| 3,347,565 | A * | 10/1967 | Konkel | 281/21.1 |
| 3,793,016 | A | 2/1974 | Eichorn | |
| 3,909,141 | A | 9/1975 | Staats | |
| 4,007,950 | A * | 2/1977 | Giulie | 281/27.3 |
| 4,072,326 | A * | 2/1978 | Groswith et al. | 281/21.1 |
| 6,332,630 | B1 * | 12/2001 | Wolff et al. | 281/27.3 |
| 6,685,415 | B2 | 2/2004 | Rush et al. | |
| 7,260,354 | B2 | 8/2007 | Ishida | |
| 7,326,018 | B2 | 2/2008 | Huotari | |
| 8,182,188 | B2 | 5/2012 | Manico et al. | |
| 2005/0052016 | A1 * | 3/2005 | Peleman | 281/21.1 |
| 2005/0258631 | A1 * | 11/2005 | Funkhouser | 281/21.1 |
| 2011/0278831 | A1 * | 11/2011 | Huotari et al. | 281/21.1 |
| 2011/0286779 | A1 | 11/2011 | Kwarta et al. | |

FOREIGN PATENT DOCUMENTS

| | | |
|---|---|---|
| EP | 0 342 957 | 9/1993 |
| JP | 2006-058392 | 3/2006 |

* cited by examiner

*Primary Examiner* — Kyle Grabowski
(74) *Attorney, Agent, or Firm* — Kevin E. Spaulding

(57) ABSTRACT

A bound document has front, back, and interior sheets with spine edges. The document has a binding strip and fasteners binding the sheets and the binding strip together. The strip has a flexible substrate with a face-attachment portion through which the fasteners are driven, and a wraparound portion that is bent so adhesive on the wraparound portion contacts the back sheet farther from the spine edge of the book than the feet of the fasteners. The strip also has a first spacer affixed to the interior surface opposite the face-attachment portion so that a fastener area is defined, the spacer at least as thick as the protrusion of the heads of the fasteners above the face-attachment portion.

14 Claims, 6 Drawing Sheets

BOUND DOCUMENT HAVING BINDING STRIP WITH SPACER

CROSS-REFERENCE TO RELATED APPLICATIONS

This application is co-filed with and has related subject matter to U.S. patent application Ser. No. 13/627,217, filed herewith, titled "BINDING STRIP INCLUDING SPACER;" and U.S. patent application Ser. No. 13/627,303, filed herewith, titled "MAKING BOUND DOCUMENT HAVING FASTENER AND SPACER;" each of which is incorporated herein by reference in its entirety.

This application has related subject matter to U.S. patent application Ser. No. 13/558,776, filed Jul. 26, 2012, titled "PRODUCING BOUND DOCUMENT HAVING INNER COVER SHEET."

FIELD OF THE INVENTION

This invention relates to books with printed covers.

BACKGROUND OF THE INVENTION

Books and photo albums are commonly assembled from single- and double-sided printed documents and photographs. Traditional bookbinding methods include gluing or stitching a set of pages together along one edge. This bound edge is then attached to a book cover, either directly, or through attachment to a spine sheet. A spine sheet spans the spine of the cover without being attached to it, and is adhered only to the two sides of the cover. The spine sheet permits a user to fully open a finished book because it flexes separately from the spine of the cover. The bound edges of the manuscript are glued to the spine sheet or cover, and the spine sheet is glued to the cover.

However, there is an increasing volume of prints made at home, or in a retail establishment. There is also a growing movement in specialty, small-print presses. Non-traditional book-makers, including specialty presses and retail photo lab operators, have a need for a process for binding materials that does not require the heavy equipment typically used in conventional bookbinding. These book-makers also have a need for printing images on the front and back covers and the spine. For example, coffee-table books often include a single image printed on all three of those surfaces so that the whole image can be viewed when looking at the outside of the open book. This is referred to herein as a "fully-wrapped cover."

Clamp- and ring-type binders, such as three-ring binders, do not have the appearance and function of conventional soft or hard covered books. Furthermore, these binders require a margin be provided in which perforations or other mounting features can be punched or placed; this margin can occupy a considerable area that could otherwise be printed with content. Moreover, sheets in these binders, e.g., three-ring binders, are susceptible to damage that permits pages to fall out, possibly without detection.

U.S. Pat. No. 7,326,018 describes a bundle of paper glue-bound to form a book. A glue band is wrapped around the bundle and heated to bind it. However, this scheme requires special equipment to wrap the glue band in a way that will not leave wrinkles or air bubbles in the band. Such wrinkles or bubbles would be perceptible to the touch of a person holding the book by the spine to read it, and could cause undesirable distraction or an impression of a lower-quality product.

U.S. Pat. No. 6,685,415 describes an adhesive matrix with a release liner. A cover is adhered to exposed adhesive after the release liner is removed. However, this scheme can leave a noticeable offset (at least the thickness of the matrix) between the endpapers at either end of the book. This can be objectionable. It also requires using a fixture to heat the adhesive matrix to attach to the inner sheets.

U.S. Pat. No. 3,909,141 describes a binding element having a flexible clamp with slots for the sheets. Although the cover is included, there are a limited number of slots, and a limited number of sheets (e.g., 1) can be inserted in each slot. Binding by this scheme is therefore limited in use, time-consuming, and tedious.

EP342957 issued to 3M (inventors Dwyer et al.) describes binding sheets together using pressure-sensitive adhesive. However, this scheme uses an adhesive spine, so does not provide full wrap-around covers.

There is, therefore, a continuing need for ways of producing bound books or other printed matter with lower cost than, and increased flexibility compared to, conventional bookbinding, while still proving a custom fully-wrapped cover. There is also a need for a way of producing books and book covers using a single printing device or technology, since many home users and retail establishments only have one type of printer (e.g., inkjet or thermal, respectively). There is also a need for books produced in these ways.

SUMMARY OF THE INVENTION

U.S. Patent Publication No. 2011/0278831 to Huotari et al. describes a binding back that is fastened to a sheet block and folded over to the opposite side of the sheet block from that to which the binding back is fastened. However, it has been determined that the fasteners used to fasten the sheet block and binding back together can be perceived through the binding back by a person holding or looking at a bound sheet block produced by this scheme. Fasteners generally protrude beyond the outer surfaces of the sheet block, raising bumps under the folded-over binding back that can be seen or felt. This can produce a less professional impression than the impression produced by a professionally-bound book. There is, therefore, a continuing need for a bound document of higher quality than previous schemes, and specifically with fasteners that are less perceptible than in prior schemes.

According to an aspect of the present invention, there is provided a bound document having a front sheet, a back sheet, and one or more interior sheet(s), each sheet having a spine edge, the bound document comprising:

a binding strip having:

a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge, wherein a border is defined laterally between the face-attachment portion and the wraparound portion and substantially parallel to the spine-alignment edge;

an adhesive layer arranged over the wraparound portion; and a first spacer affixed to the interior surface opposite the face-attachment portion so that a fastener area is defined, the first spacer having a spacer thickness;

one or more fasteners binding the sheets and the binding strip together, the one or more fasteners driven through the fastener area and extending a head thickness above the face-attachment portion and a foot thickness below the back sheet, a fastener-foot area being defined on the back sheet;

wherein the first spacer thickness is at least the head thickness, the spine-alignment edge of the binding strip and the spine edges of the sheets are substantially aligned, and the wraparound portion is bent so that the adhesive layer is in contact with the back sheet farther from the spine edge of the back sheet than the fastener-foot area.

An advantage of this invention is that a bound document as claimed has a more professional appearance, since the fasteners are concealed. Various aspects conceal fastener protrusions on both sides of a sheet block. Various aspects provide a straight, even spine, which makes the bound document easier to store on, and retrieve from, a bookshelf.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
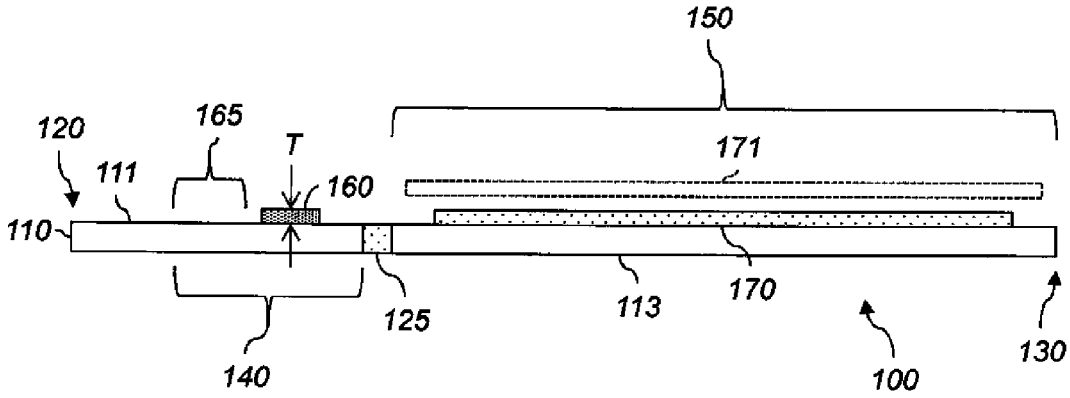
FIGS. 1-3 are elevations of binding strips according to various aspects.

The attached drawings are for purposes of illustration and are not necessarily to scale.

DETAILED DESCRIPTION OF THE INVENTION

Reference is made to commonly-assigned U.S. Pat. No. 8,182,188, incorporated herein by reference.

In the following description, some aspects will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, methods described herein. Other aspects of such algorithms and systems, and hardware or software for producing and otherwise processing the image signals involved therewith, not specifically shown or described herein, are selected from such systems, algorithms, components, and elements known in the art. Given the system as described herein, software not specifically shown, suggested, or described herein that is useful for implementation of various aspects is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods according to various aspects.

The electrophotographic (EP) printing process can be embodied in Electrostatographic printers such as electrophotographic printers that employ toner developed on an electrophotographic receiver can be used, as can ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying colorant to the receiver, and one or more post-printing finishing system(s) (e.g. a UV coating system, a glosser system, or a laminator system). Devices including printers, copiers, scanners, and facsimiles, and analog or digital devices, are all referred to herein as "printers." Electrophotographic, inkjet, thermal, optical, or other types of printers can be used. For example, an electrophotographic printer can be used, such as described in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Described herein are various aspects of binding strips, bound documents, and ways of making bound documents. Binding strips can use spacers to conceal staple heads and feet, or other protrusions from fasteners. Spacers can be positioned according to the thickness of a particular book. Spacers can be tapered away from the spine to provide a cleaner appearance. Spacers can be applied to fastened sheets manually or automatically, or can be included as part of a binding strip, or a combination thereof. Spacers can have hot-melt adhesive to reduce the probability they will become affixed incorrectly. Spacers can be positioned then heated to bind them to a binding strip or a bound document. Other aspects are also described herein.

Figure 6:
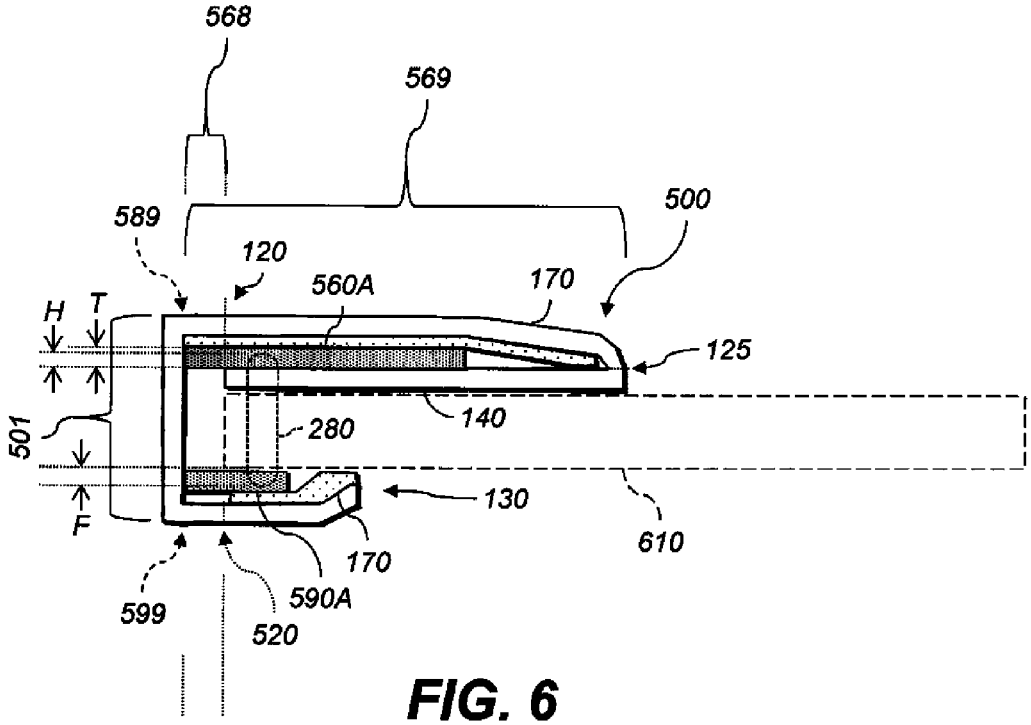
FIGS. 6-7 are elevational cross-sections of bound documents according to various aspects.

FIG. 1 is an elevation of binding strip 100 according to various aspects. Binding strip 100 is useful for binding a sheet block to produce a bound document (e.g., as shown in FIG. 6). Substrate 110 has interior surface 111 and opposed exterior surface 113. Spine-alignment edge 120 can be aligned with a spine edge of a sheet block to be bound, as discussed below. Free edge 130 is opposite spine-alignment edge 120 and substantially non-perpendicular thereto. Free edge 130 and spine-alignment edge 120 can be parallel or can extend along respective, different axes within 45° of each other. Face-attachment portion 140 of exterior surface 113 is adjacent to spine-alignment edge 120. Wraparound portion 150 of interior surface 111 is adjacent to free edge 130. Border 125 is defined laterally between face-attachment portion 140 and wraparound portion 150. Border 125 is substantially parallel to spine-alignment edge 120. Adhesive layer 170 is arranged over wraparound portion 150, and is optionally covered in whole or in part by removable protective cover 171 disposed over adhesive layer 170.

Spacer 160 is affixed to interior surface 111 opposite face-attachment portion 140 and has thickness T. Spacer 160 can also be affixed to wraparound portion 150. Fastener area 165 is thus defined. Fasteners can be driven through substrate 110 in fastener area 165 to bind sheets together, as discussed below.

Figure 2:
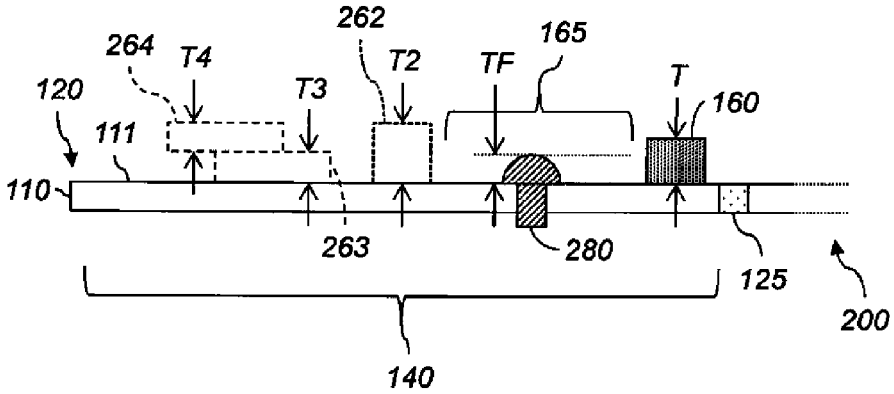

FIG. 2 is an elevation of binding strip 200 according to various aspects. Substrate 110, interior surface 111, spine-alignment edge 120, border 125, face-attachment portion 140, spacer 160, thickness T, and fastener area 165 are as shown in FIG. 1. Fastener 280 is shown in fastener area 165.

In various aspects, fastener 280 protrudes above interior surface 111 by thickness TF of the protruding portion of the fastener. The protrusion is represented graphically as a semicircle. Thickness T of spacer 160 is greater than thickness TF of the fastener protrusion. In an example, fastener 280 is a staple, and the protrusion is the horizontal portion of the staple where it rides on interior surface 111. Fastener 280 can also include a bolt, post, rivet, grommet, round head fastener, brass fastener, brad, split pin, cotter pin, wire, thread, plastic comb, binding clip, or other fastener protruding above inner surface 111. The terms "above" and "below" in this disclosure describe relative orientation of parts and do not constrain the orientation of parts in space or with respect to any other parts, except as described.

In various aspects, spacer 160 (or other spacers described herein) includes plastic, thermoplastic, foam, a material included in substrate 110, artificial leather, or natural leather. In various aspects, substrate 110 includes plastic, foam, artificial leather, or natural leather.

In various aspects, spacer 262 is affixed to interior surface 111 on the opposite side of substrate 110 from face-attachment portion 140. Spacer 262 is affixed on the opposite side of fastener area 165 from first spacer 160. Spacer 262 has selected thickness T2. In various of these aspects, the thickness of the spacer laterally closer to the border is less than the thickness of the spacer laterally farther from the border. Here, thickness T of spacer 160 laterally closer to border 125 than spacer 262 is less than thickness T2 of spacer 262. As a result, when wraparound portion 150 (FIG. 1) is wrapped counterclockwise around spacers 160, 262, the result will be a wedge shape as wraparound portion 150 rides over spacers 160, 262. This is discussed further below with respect to FIG. 6.

In various aspects, two spacers are disposed over each other. In this example, spacer 264 having thickness T4 is disposed over spacer 263 having thickness T3. Spacer 160 is laterally closer to border 125 than spacers 263, 264. The sum of the respective selected thicknesses T3, T4 of spacers 263, 264 is greater than the thickness of the first spacer. This provides a wedge effect similar to that provided by spacer 262. Thicknesses T3 and T4 can be equal or not.

Figure 3:
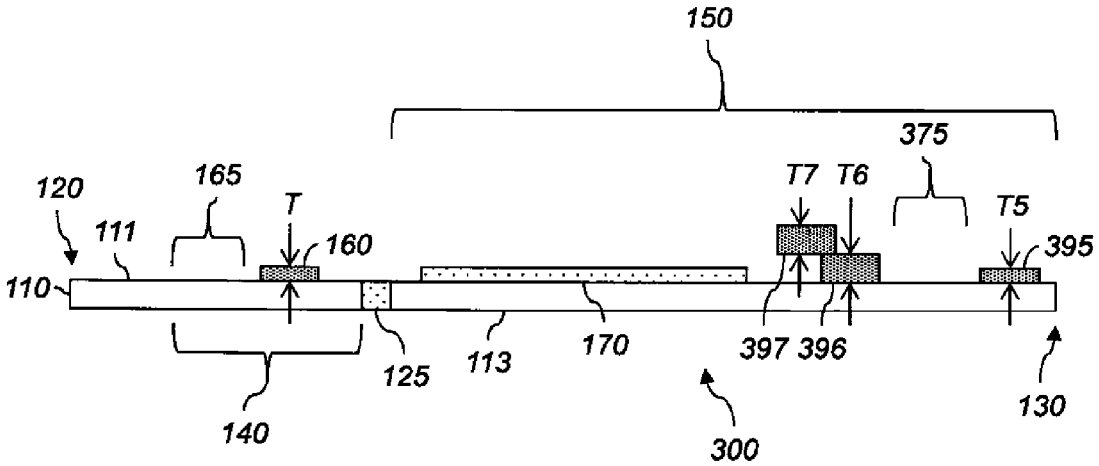

FIG. 3 is an elevation of binding strip 300 according to various aspects. Substrate 110, interior surface 111, spine-alignment edge 120, border 125, free edge 130, face-attachment portion 140, spacer 160, thickness T, fastener area 165, exterior surface 113, wraparound portion 150, and adhesive layer 170 are as shown in FIG. 1.

Substrate 110 has fastener-foot area 375 closer to free edge 130 than to border 125. The strip further includes spacer 395 having selected thickness T5. Spacer 395 is affixed to interior surface 111 adjacent to fastener-foot area 375. When a fastener protrudes from a sheet block (see FIG. 6, below) into fastener-foot area 375, spacer 395 reduces the visibility of the protruding foot of the fastener through wraparound portion 150.

In various aspects, spacer 396 having selected thickness T6 is affixed to interior surface 111 opposite fastener-foot area 375 from spacer 395. In various aspects, the thickness of the spacer laterally closer to the free edge is less than the thickness of the spacer laterally farther from the free edge. In an example shown, thickness T5 of spacer 395 is less than thickness T6 of spacer 396. This provides a wedge appearance, e.g., as described above with respect to spacers 160, 263 (FIG. 2).

In various aspects, spacer 397 having selected thickness T7 is disposed over spacer 396. Spacer 395 is laterally closer to free edge 130 than spacers 396, 397. The sum of the respective selected thicknesses T6, T7 of spacers 396, 397 is greater than thickness T5 of spacer 395.

Figure 4:
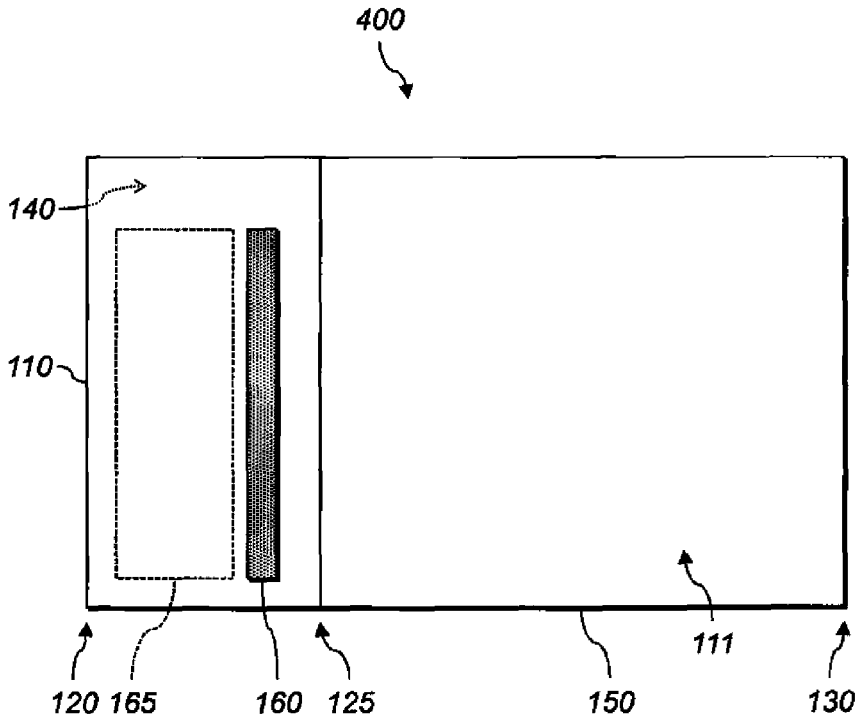
FIGS. 4-5 are plans of binding strips according to various aspects.

FIG. 4 is a plan of binding strip 400 according to various aspects. Substrate 110, interior surface 111, spine-alignment edge 120, border 125, free edge 130, face-attachment portion 140, wraparound portion 150, spacer 160, and fastener area 165 are as shown in FIG. 1. As indicated by the dotted arrow, face-attachment portion 140 is on the opposite side from that shown. In the example shown, fastener area 165 extends substantially parallel to border 125. In various aspects, spacer 160 extends substantially parallel to border 125 over substantially all of a selected sheet-block length in the direction of extent of border 125 (sheet blocks are discussed below with respect to FIG. 7).

Figure 5:
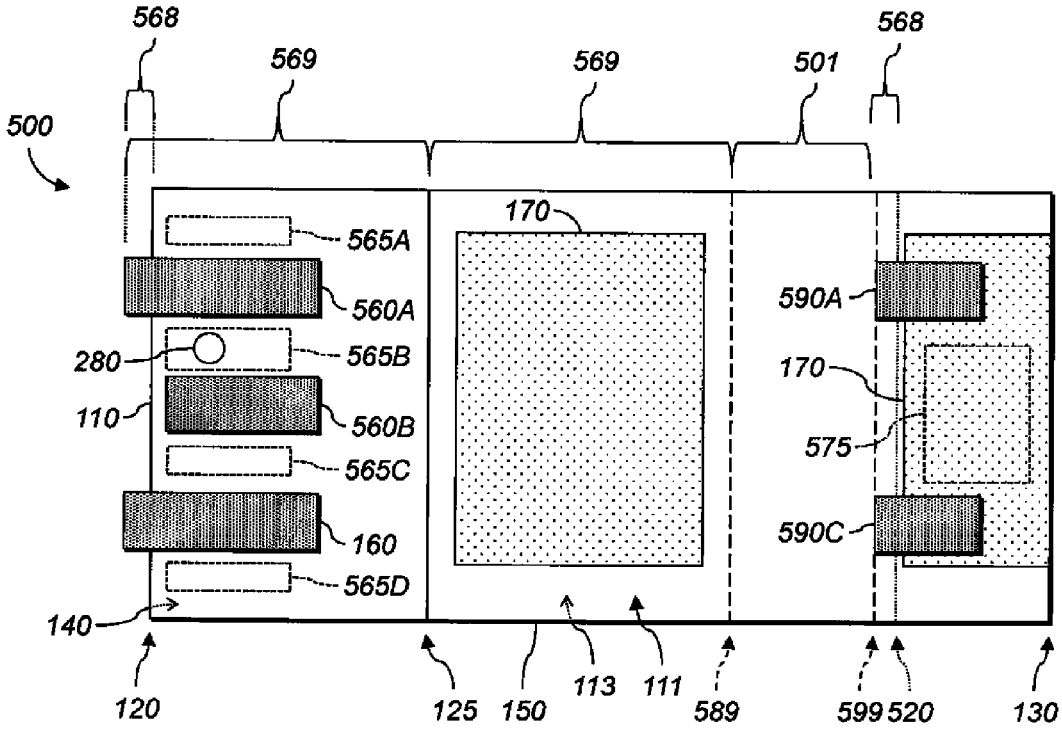

FIG. 5 is a plan of binding strip 500 according to various aspects. Substrate 110, interior surface 111, spine-alignment edge 120, border 125, free edge 130, face-attachment portion 140, and wraparound portion 150 are as shown in FIG. 1. As indicated by the dotted arrow, face-attachment portion 140 is on the opposite side from that shown. In the example shown, a fastener area includes a plurality of disconnected sub-areas 565A, 565B, 565C, 565D separated by boundary regions, e.g., regions underlying spacers 160, 560A, 560B. The boundary regions can be rectangular. The boundary regions extend substantially perpendicular to border 125. In addition to spacer 160, binding strip 500 further includes one or more additional spacer(s) 560A, 560B. Spacer 160 and additional spacer(s) 560A, 560B are affixed to interior surface 111 opposite face-attachment portion 140 in respective sub-areas. In this example, each spacer 160, 560A, 560B fills its respective sub-area, so the sub-areas are not labeled individually. In this example, adhesive layer 170 is divided into two disjoint portions spaced apart across binding strip 500.

In various aspects, at least one spacer 160, 560A, 560B is affixed to interior surface 111 so it crosses spine-alignment edge 120. In this example, spacers 160 and 560A cross spine-alignment edge 120. As a result, when wraparound portion 150 is folded at border 125, spacers 160, 560A provide margin 568. This is discussed below with respect to FIG. 6.

In various aspects, substrate 110 has a back-side alignment edge 520 between border 125 and free edge 130. One or more spacer(s) 590A, 590C having respective selected thicknesses are affixed to interior surface 111. Spacers 590A, 590C cross back-side alignment edge 520. Any number of spacers, one or more, can be used either crossing back-side alignment edge 520 or between back-side alignment edge 520 and free edge 130, in any combination.

In various aspects, substrate 110 is flexible. In various aspects, substrate 110 includes a rigid or semi-rigid support substantially including face-attachment portion 140 and a flexible support substantially including wraparound portion 150. As used herein, semi-rigid supports are supports that cannot be creased without substantially damaging them along the line of the crease (e.g., paperboard), or that require a tool with overunity mechanical advantage to shape them without damage (e.g., solid copper tubes). The two supports are joined substantially along the border. In this way, face-attachment portion 140 is substantially rigid, and wraparound portion 150 is substantially flexible. It is not required that the join between the supports coincide exactly with border 125. The join can be wider or narrower than border 125.

FIG. 6 is an elevational cross-section of a bound document including binding strip 500 and sheet block 610 according to various aspects. Sheet block 610 includes a front sheet, a back sheet, and one or more interior sheet(s), and each sheet has a respective spine edge, as is discussed below with respect to FIG. 7. For clarity, individual sheets in sheet block 610 are not shown in this figure. The terms "front" and "back" do not constrain the orientation or content of the bound document or any sheet.

Binding strip 500 has flexible substrate 110 (FIG. 1) having interior surface 111 and exterior surface 113 (both FIG. 5), spine-alignment edge 120, free edge 130 opposite spine-alignment edge 120 and substantially non-perpendicular thereto, face-attachment portion 140 of the exterior surface adjacent to spine-alignment edge 120, and wraparound portion 150 (FIG. 5) of interior surface 111 adjacent to free edge 130. Border 125 (FIG. 5) is defined laterally between face-attachment portion 140 and wraparound portion 150 and substantially parallel to spine-alignment edge 120. Adhesive layer 170 is arranged over wraparound portion 150. Spacer 560A (which has thickness T) is affixed to interior surface 111 opposite face-attachment portion 140 so that a fastener area is defined. In this example, the fastener area includes sub-areas 565A, 565B, 565C, 565D (FIG. 5).

One or more fasteners (here, fastener 280) bind the sheets and binding strip 500 together. Fasteners (e.g., fastener 280) are driven through the fastener area (here, sub-areas 565A, 565B, 565C, 565D, FIG. 5). Fastener 280 extends head thickness H above face-attachment portion 140 and foot thickness F below the back sheet. Fastener-foot area 575 (FIG. 5) is defined on wraparound portion 150, and a corresponding fastener-foot area (fastener-foot area 775 on FIG. 7) is defined on the back sheet.

Spacer thickness T is at least head thickness H. Spine-alignment edge 120 of binding strip 500, and the spine edges of the sheets in sheet block 610, are substantially aligned. Wraparound portion 150 is bent so that adhesive layer 170 is in contact with the back sheet (bottom of sheet block 610) farther from the spine edge of the back sheet than the fastener-foot area. In various aspects, adhesive layer 170 additionally contacts the back sheet between the fastener-foot area and the spine edge of the back sheet.

Referring to FIGS. 5 and 6, spacers 160, 560A, 590A, and 590C (which are rigid or semi-rigid), and their overhang past spine alignment edge 120 and back-side alignment edge 520, influence the shape of the spine resulting from bending wraparound portion 150 around sheet block 610. Spacer 590A is referred to as a "back-side spacer." When binding strip 500 is bent back along border 125, the wraparound portion cannot bend downwards until it clears spacers 160, 560A. As a result, bend location 589 is defined distance 569 away from border 125. Distance 569 is the distance along binding strip 500 from sheet-alignment edge 120 to border 125, plus the size of margin 568, i.e., the distance by which spacers 160, 560A overhang spine-alignment edge 120.

Similarly, in various aspects, wraparound portion 150 is not bent closer to free edge 130 than spacers 590A, 590C. (A bend can be placed between spacers 590A, 590C and free edge 130 if enough of adhesive layer 170 remains to contact the back sheet farther from the spine edge of the back sheet than the fastener-foot area.) Bend location 599 is defined at the edge of spacers 590A, 590C farther from free edge 130, or between that edge and bend location 589. Sheet block 610 is thinner than distance 501 between bend locations 589, 599 to provide a binding in which all sheets are parallel. In this example, spacers 590A, 590C overhang back-side alignment edge by the size of margin 568, the same distance as spacers 160, 560A overhang spine-alignment edge 120. In various aspects, the overhang distances can be the same or different.

Figure 7:
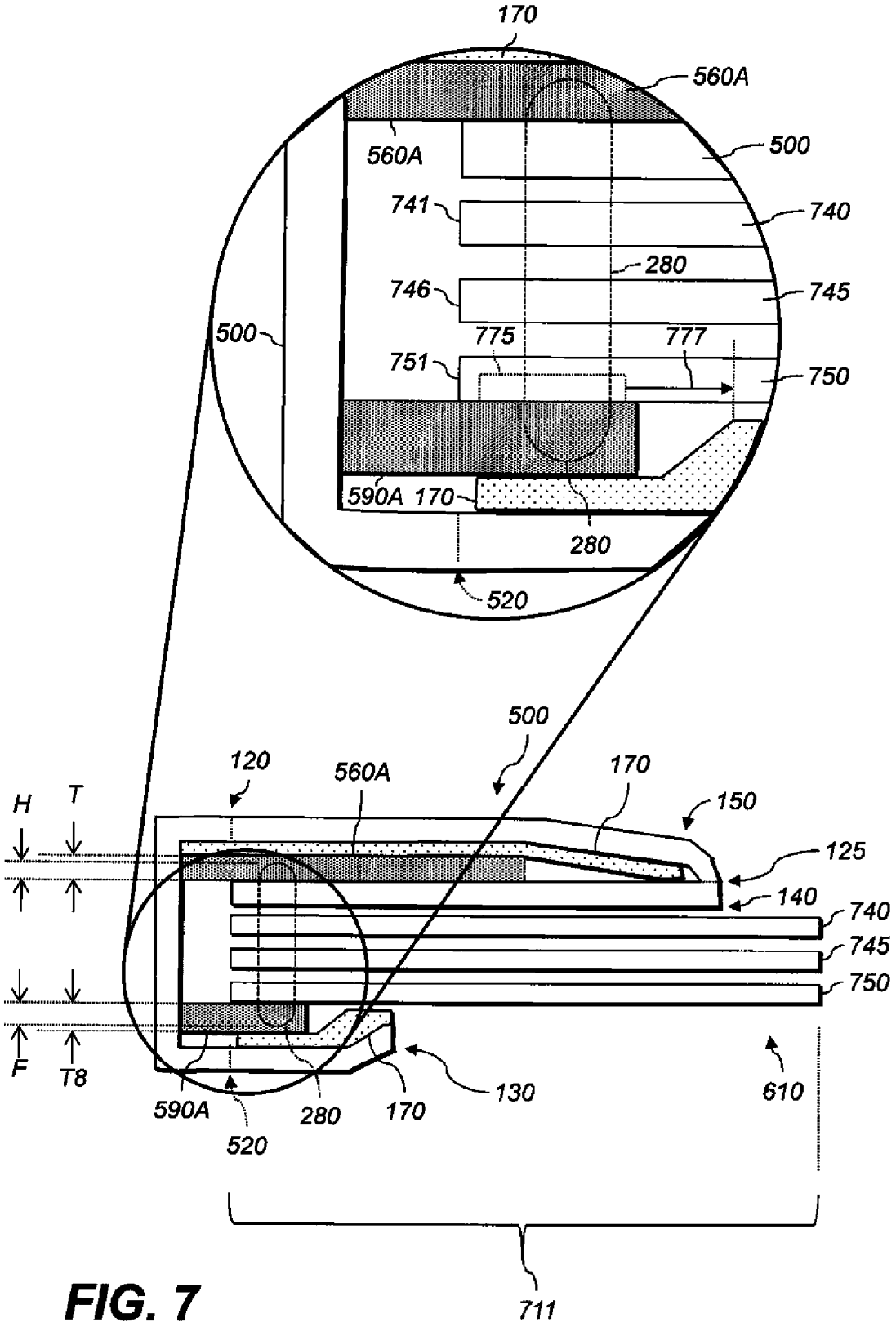

FIG. 7 is an elevational cross-section of a bound document including binding strip 500 and sheet block 610 according to various aspects. Binding strip 500, adhesive layer 170, spine-alignment edge 120, border 125, free edge 130, spacers 560A, 590A, thicknesses F, H, and T, and fastener 280 are as shown in FIG. 6. Face-attachment portion 140 and wraparound portion 150 are as shown in FIG. 5.

Sheet block 610 includes front sheet 740, interior sheet 745 (or more than one interior sheet), and back sheet 750. Sheet block 610 has a selected sheet-block length in the direction perpendicular to the plane of the figure. In an example, sheets 740, 745, 750 are 8.5"×11" (215.9 mm×279.4 mm) pages. Sheet-block width 711 is 8.5" (215.9 mm) and the sheet-block length (not shown in this cross-section) is 11" (279.4 mm). As shown in the inset, each sheet 740, 745, 750 has a respective spine edge 741, 746, 751. Spine edges 741, 746, 751 are substantially aligned (within normal tolerances for assembling sheets into blocks) so that sheets 740, 745, 750 form sheet block 610. Binding strip 500 and sheet block 610 are arranged with respect to each other so that spine-alignment edge 120 and back-side alignment edge 520 substantially align (within assembly tolerances) with spine edges 741, 746, and 751. In various aspects, adhesive layer 170 is in contact with back sheet 750 farther from spine edge 751 of back sheet 750 than fastener-foot area 775. This is shown by arrow 777. Arrow 777 starts at fastener-foot area 775. Arrow 777 ends parallel to the closest point to spine edge 751 at which adhesive layer 170 contacts back sheet 750. In other aspects, adhesive layer 170 contacts back sheet 750 closer to spine edge 751 than fastener-foot area 775, or in fastener-foot area 775, or any combination.

Fastener 280 binds front sheet 740, interior sheet(s) 745, back sheet 750, and binding strip 500 together. Fastener 280 extends foot thickness F below back sheet 750. Fastener-foot area 775 on back sheet 750 is opposite fastener-foot area 575 (FIG. 5) on wraparound portion 150. Fastener 280 passes through back sheet 750 in fastener-foot area 775.

In various aspects, fastener-foot area 775 extends closer to free edge 130 than to border 125. The distances between fastener area 775 and either free edge 130 or border 125 are measured along binding strip 500; the shortest such distances are considered if fastener-foot area 775 is not parallel to free edge 130 or to border 125. In these aspects, the bound document further includes second spacer 590A having a selected spacer thickness T8 (FIG. 7) affixed to interior surface 111 (FIG. 5) adjacent to fastener-foot area 775. That is, spacer 590A is provided as part of the bound document rather than as part of binding strip 500, and spacer 590A is affixed to binding strip 500 (e.g., using adhesive layer 170). This permits using binding strip 500 to conceal the foot of fastener 280 on bound documents of any thickness. In aspects in which spacer 590A is attached to binding strip 500, such as shown in FIG. 5, the thickness of sheet block 610 (FIG. 6) should correspond to distance 569 (FIG. 5) so that spacer 590A will be laterally adjacent to the protruding foot of fastener 280 to conceal that protrusion.

In various of these aspects, spacer 590A extends substantially parallel to border 125 over substantially all of a length of back sheet 750 in the direction of extent of border 125. This direction is perpendicular to the plane of the figure in the example shown.

In various of these aspects, one or more additional spacer(s) (not shown) are affixed to back sheet 750 adjacent to fastener-foot area 775. Spacer 590A and each of the additional spacer(s) each cover a respective one of a plurality of disconnected sub-areas separated by boundaries extending substantially perpendicular to border 125. (An example of additional spacers and sub-areas is shown in FIG. 5.) In these aspects, in contrast to FIG. 5, the spacers are affixed to back sheet 750 and are not part of binding strip 500.

In various aspects, at least one of spacer 590A or the additional spacer(s) is affixed to back sheet 750 so a portion thereof crosses spine edge 751 of back sheet 750. This permits forming the spine, as discussed above.

In various aspects, spacer 590A is affixed to back sheet 750 farther from spine edge 751 of back sheet 750 than fastener-foot area 775. Spacer 590A has a selected thickness T8 at least as large as foot thickness F. Wraparound portion 150 is bent so that adhesive layer 170 is in contact with spacer 590A. In various of these aspects, another spacer (e.g., spacer 590C, FIG. 5) is affixed to back sheet 750 opposite fastener-foot area 775 from spacer 590A. The opposition can be in any direction on the sheet, e.g., parallel to free edge 130 as shown in FIG. 5, perpendicular to free edge 130, or another direction. In various of these aspects, spacers 590A and 590C are arranged on opposite sides of fastener-foot area 775 along a direction perpendicular to border 125. The thickness of the spacer laterally closer to free edge 130 is less than the thickness of the spacer laterally farther from free edge 130. This can provide a wedge shape, as discussed herein. In various aspects, adhesive layer 170 contacts back sheet 750 farther from spine edge 751 of back sheet 750 than spacer 590A, as discussed above.

In this example, sheets 740, 745, 750 form a stack. Sheets 740, 745, 750 can be printed (or not) cut sheets, or cut portions of media printed in a roll-fed printer. Roll-fed media can also be folded and bound so that the edges can be cut to form pages after the bound document is assembled. Sheets 740, 745, 750 can include, but are not limited to, natural and synthetic papers; synthetic sheets such as, but not limited to, plastic, MYLAR, or vinyl; cardboard and other paper or pulp materials; stiff fabrics; reinforced fabrics; mixed media sheets; photographs; metal sheets; glass plates; and other sheet-like materials.

Sheets 740, 745, 750 can be the same type of medium, or different media. Each medium independently can be decorative, plain, mixed media, or have attachments thereto. Commercially available media such as photobook pages, templates, and framing pages (for example, of paper, paperboard, cardboard), can be used. One or more sheets 740, 745, 750 can have a V-fold shape, so that the corresponding spine edge 741, 746, 751 is a V-folded edge, the free edges forming the edges of the pages for turning. Pop-up pages, and pages with extension sections that open out from a cover of the bound document, can also be used. Image content can be printed on one or more sheets 740, 745, 750 using thermal printing, ink jet (drop-on-demand or continuous), laser printing, electrophotographic printing, or other techniques.

In various aspects, front sheet 740 and back sheet 750 are cover sheets. Examples of materials useful for cover sheets include, but are not limited to cardboard, paperboard, plastic, paper, any type of animal skin, metal, metallic coated materials, and fabric. One or both sheets 740, 750 can include a section for insertion of a photograph, paper, memento, or other object on the front cover. Sheets 740, 750, or at least a portion thereof, can be printable or printed using, for example, thermal printing, ink jet (drop-on-demand or continuous), laser printing, electrophotographic, or other techniques, or can be writable with pens, pencils, or markers.

Sheets 740, 750 can have the same dimensions as interior sheet(s) 745. If it is desirable to have at least some of the media exposed, such as tabbed pages, when the cover is closed, the bound document can be narrower than at least some of the interior sheet(s) 745, shorter than at least some of the interior sheet(s) 745, or both. To protect the media, sheets 740, 750 can be wider than all the interior sheet(s) 745 in sheet block 610, longer than interior sheet(s) 745, or a combination thereof.

Figure 9:
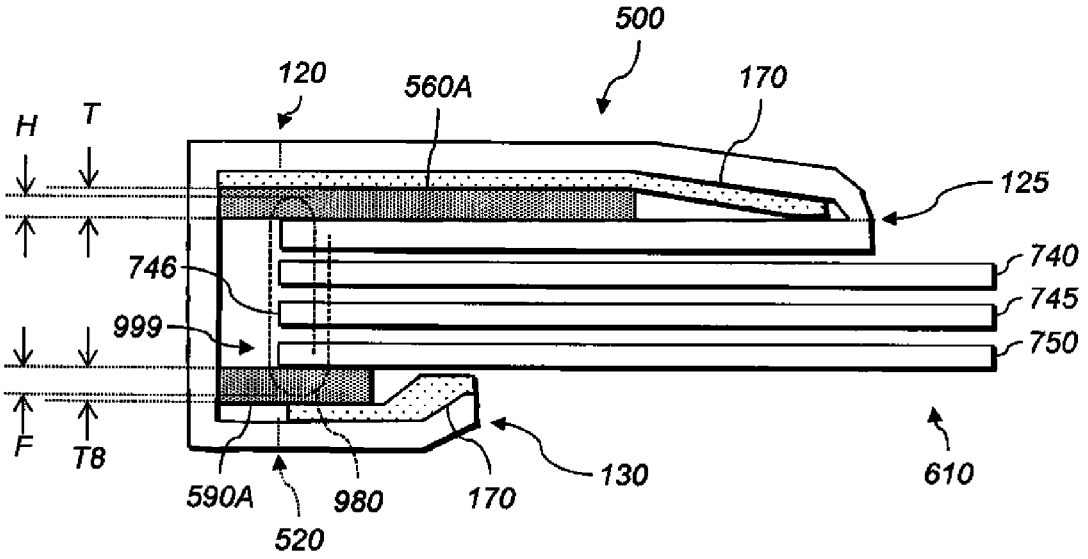
FIG. 9 is an elevational cross-section of a bound document according to various aspects.

FIG. 9 is an elevational cross-section of a bound document including binding strip 500 and sheet block 610 according to various aspects. Binding strip 500, adhesive layer 170, spine-alignment edge 120, border 125, free edge 130, spacers 560A, 590A, thicknesses F, H, T, and T8, sheets 740, 745, and 750, and spine edge 746 of interior sheet 745 are as shown in FIG. 7. Fastener 980 includes wires extending through at least some of the sheets 740, 745, 750, as shown. The wires protrude at least partly beyond spine edge 746 of interior sheet 745, i.e., to the left of spine edge 746 in this figure. The overhang of spacer 560A beyond spine-alignment edge 120 and of spacer 590A beyond back-side alignment edge 520 provides cavity 999. The protrusions of fastener 980 beyond spine edge 746 are contained within cavity 999, so are not visible to a person holding the bound document. This provides a more professional appearance than would binding without overhanging spacers, but the latter technique can be used as described herein. Examples of binding pages together by passing wires through them are given in U.S. Pat. No. 361,152 to Fifield et al, incorporated herein by reference. In various aspects, fastener 980 is a hog ring, e.g., fastened by BOSTITCH P7 collated ring pliers.

Figure 8:
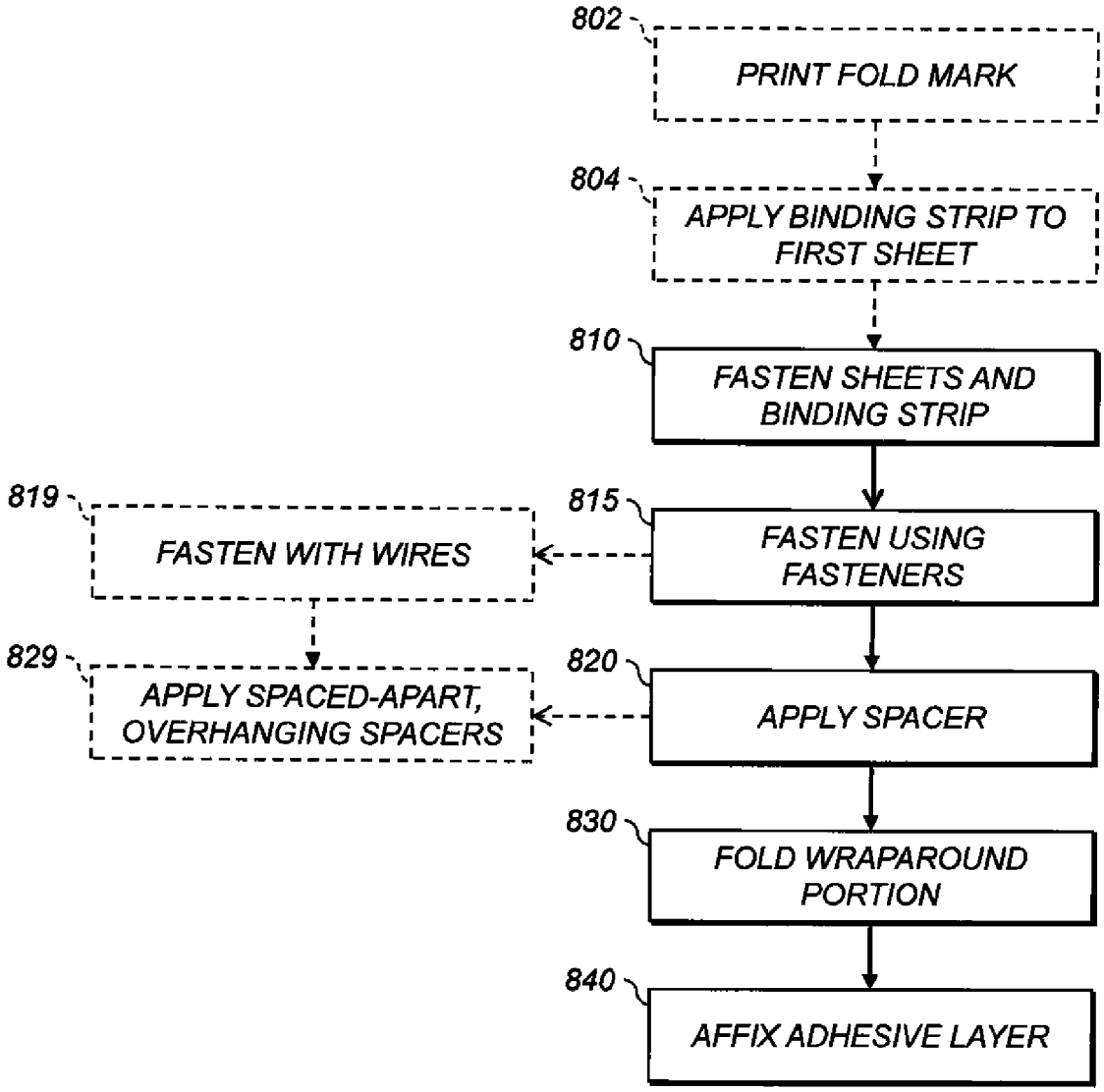
FIG. 8 is a flowchart of methods of binding a plurality of sheets to form a bound document according to various aspects.

FIG. 8 shows methods of binding a plurality of sheets to form a bound document according to various aspects. The plurality of sheets includes a front sheet, a back sheet, and one or more interior sheet(s), each sheet having a respective spine edge. The sheets are bound using a binding strip. Processing begins with optional step 802 or step 810. An arrow with a triangular arrowhead connects a step to a step that can follow it. An arrow with an open arrowhead connects a step to a substep that step can include.

In optional step 802, a controller is used to automatically print a fold mark on the first sheet at a position selected based on the number of sheets in the plurality of sheets, or on the thicknesses of the sheets, or a combination thereof. The fold mark indicates where the binding strip should be folded, i.e., approximately where the border between the face-attachment portion and the wraparound portion (discussed below) should be. Optional step 802 is followed by optional step 804.

In optional step 804, the binding strip is applied to the first sheet so that the border is substantially aligned with the printed fold mark. Optional step 804 is followed by step 810.

In step 810, using a plurality of fasteners, the plurality of sheets and a binding strip having a spine-alignment edge are fastened together. The respective spine edges of all the sheets, and the spine-alignment edge, are substantially aligned. This will result in a bound document with a single spine, such as a conventional book or magazine. For sheets with multiple spines, these steps can be applied multiple times with different spine edges. The spine edges of the sheets and the spine-alignment edge of the binding strip can be aligned using conventional printing alignment devices such as fixed stops against which each spine edge is driven.

The binding strip includes a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge. A border is defined laterally between the face-attachment portion and the wraparound portion and substantially parallel to the spine-alignment edge. An adhesive layer is arranged over the wraparound portion. A first spacer is affixed to the interior surface opposite the face-attachment portion so that a fastener area is defined, the first spacer having a selected thickness. Examples of binding strips useful with various aspects of these methods are described above with reference to FIGS. 1-7.

In various aspects, the selected thickness is greater than a selected thickness of a fastener protrusion, e.g., a staple wire or brass-fastener head. In this way, when the wraparound portion wraps over the spacer, the spacer will conceal otherwise-visible fastener protrusions. This concealment can provide a product with a more professional appearance than a product without such concealment.

In various aspects, a second spacer is applied to the interior surface opposite the face-attachment portion, opposite the fastener area from the first spacer, the second spacer having a second selected thickness. The thickness of the spacer laterally closer to the border can be less than the thickness of the spacer laterally farther from the border to provide a wedge effect. In various aspects, a third spacer is applied over the second spacer, the third spacer having a selected thickness. The first spacer is laterally closer to the border than the second spacer or the third spacer. The sum of the respective selected thicknesses of the second and third spacers is greater than the thickness of the first spacer. Examples of these aspects are shown in FIG. 2.

In step 815, which is part of step 810, the sheets and the binding strip are fastened together by passing fasteners through the sheets and through the fastener area of the binding strip. The fasteners are driven through the fastener area and extend a head thickness above the front sheet and a foot thickness below the back sheet, so that a fastener-foot area is defined on the back sheet. Step 815 is followed by step 820 and can include optional step 819.

In optional step 819, which is part of step 815, one or more wires are driven through at least some of the sheets. The driven wires are then bent so that the wires protrude at least partly beyond the spine edge(s) of the interior sheet(s). In various aspects, a plurality of spacers is applied, as discussed below with respect to step 829. The wires are driven through areas of the sheets laterally between the spacers. An example is shown in FIG. 7. Optional step 819 is followed by optional step 829.

In step 820, a back-side spacer is applied to the back sheet adjacent to the fastener-foot area. Spacers such as described above with reference to FIGS. 1-3 can be used. In various aspects, an elongated spacer is applied, oriented substantially parallel to the spine edge of the back sheet. Step 820 is followed by step 830 and can include optional step 829.

In optional step 829, which is part of step 820, a plurality of spacers is applied to the back sheet. Each spacer is applied so that it extends substantially perpendicular to the spine edge of the back sheet and hangs over the spine edge of the back sheet. Other spacers not hanging over the spine edge of the back sheet can also be applied. In various aspects, this step is used with step 819, and the wires protrude between the spacers. Steps 819 and 829 can be performed in either order.

In step 830, the wraparound portion of the binding strip is folded around the spine edges of the sheets. The wraparound portion is thus bent so that the adhesive layer is in contact with the back-side spacer. Alternatively or additionally, the adhesive layer can be in contact with the back sheet farther from the spine edge of the back sheet than the fastener-foot area. In aspects using steps 802 and 804, the applied binding strip is folded according to the fold mark. Step 830 is followed by step 840.

In step 840, the adhesive layer of the binder strip is affixed to the sheet edges of at least some of the sheets, and to the back sheet. This can be done, e.g., by applying pressure, heat, or ultraviolet radiation, depending on the type of adhesive used. The adhesive layer can adhere to the spacers or not. In various aspects, the adhesive layer includes a hot-melt adhesive and this step further includes heating the adhesive layer.

The invention is inclusive of combinations of the aspects described herein. References to "a particular aspect" and the like refer to features that are present in at least one aspect of the invention. Separate references to "an aspect" or "particular aspects" or the like do not necessarily refer to the same aspect or aspects; however, such aspects are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

PARTS LIST

100 binding strip
110 substrate
111 interior surface
113 exterior surface
120 spine-alignment edge
125 border
130 free edge
140 face-attachment portion
150 wraparound portion
160 spacer
165 fastener area
170 adhesive layer
171 removable protective cover
200 binding strip
262, 263, 264 spacer
280 fastener
300 binding strip
375 fastener-foot area
395, 396, 397 spacer
400 binding strip
500 binding strip
501 distance
520 back-side alignment edge
560A, 560B spacer
565A, 565B, 565C, 565D sub-area
568 margin
569 distance
575 fastener-foot area
589, 599 bend location
590A, 590C spacer
610 sheet block
711 sheet-block width
740 front sheet
741 spine edge
745 interior sheet
746 spine edge
750 back sheet
751 spine edge
775 fastener-foot area
777 arrow
802 print fold mark step
804 apply binding strip to first sheet step
810 fasten sheets and binding strip step
815 fasten using fasteners step

819 fasten with wires step
820 apply spacer step
829 apply spaced-apart, overhanging spacers step
830 fold wraparound portion step
840 affix adhesive layer step
980 fastener
999 cavity
F foot thickness
H head thickness
T thickness
T2, T3, T4, T5, T6, T7, T8 thickness
TF thickness

The invention claimed is:

1. A bound document having a front sheet, a back sheet, and one or more interior sheet(s), each sheet having a spine edge, the bound document comprising:

a binding strip having:

a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge, wherein a border is defined laterally between the face-attachment portion and the wraparound portion and substantially parallel to the spine-alignment edge;

an adhesive layer arranged over the wraparound portion; and first and second spacers affixed to the interior surface opposite the face-attachment portion so that a fastener area is defined on the interior surface positioned adjacent to and between the first and second spacers such that the first spacer is on one side of the fastener area and the second spacer is on an opposite side of the fastener area, the first spacer having a first spacer thickness and the second spacer having a second spacer thickness;

one or more fasteners binding the sheets and the binding strip together, the one or more fasteners driven through the fastener area and extending a head thickness above the face-attachment portion and a foot thickness below the back sheet, a fastener-foot area being defined on the back sheet;

wherein the first spacer thickness and the second space thickness are at least as large as the head thickness, the spine-alignment edge of the binding strip and the spine edges of the sheets are substantially aligned, and the wraparound portion is bent so that the adhesive layer is in contact with the back sheet farther from the spine edge of the back sheet than the fastener-foot area.

2. The bound document according to claim 1, wherein the first and second spacers extend substantially parallel to the border.

3. A bound document having a front sheet, a back sheet, and one or more interior sheet(s), each sheet having a spine edge, the bound document comprising:

a binding strip having:

a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge, wherein a border is defined laterally between the face-attachment portion and the wraparound portion and substantially parallel to the spine-alignment edge;

an adhesive layer arranged over the wraparound portion; and a first spacer affixed to the interior surface opposite the face-attachment portion so that a fastener area is defined, the first spacer having a spacer thickness;

one or more fasteners binding the sheets and the binding strip together, the one or more fasteners driven through the fastener area and extending a head thickness above the face-attachment portion and a foot thickness below the back sheet, a fastener-foot area being defined on the back sheet;

wherein the first spacer thickness is at least as large as the head thickness, the spine-alignment edge of the binding strip and the spine edges of the sheets are substantially aligned, and the wraparound portion is bent so that the adhesive layer is in contact with the back sheet farther from the spine edge of the back sheet than the fastener-foot area wherein the fastener area includes a plurality of disconnected sub-areas separated by boundary regions extending substantially perpendicular to the border, and the binding strip further includes one or more additional spacer(s), the first spacer and the additional spacer(s) affixed to the boundary regions on the interior surface opposite the face-attachment portion.

4. The bound document according to claim 3, wherein the one or more fasteners include wires extending through at least some of the sheets and protruding at least partly beyond the spine edge(s) of the interior sheet(s).

5. The bound document according to claim 3, wherein at least one of the first spacer or the one or more additional spacer(s) is affixed to the interior surface so it crosses the spine-alignment edge.

6. The bound document according to claim 5, wherein the flexible substrate has a back-side alignment edge between the border and the free edge, further including a second spacer having a second thickness and affixed to the interior surface so it crosses the back-side alignment edge.

7. A bound document having a front sheet, a back sheet, and one or more interior sheet(s), each sheet having a spine edge, the bound document comprising:

a binding strip having:

a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge, wherein a border is defined laterally between the face-attachment portion and the wraparound portion and substantially parallel to the spine-alignment edge:

an adhesive layer arranged over the wraparound portion; and a first spacer affixed to the interior surface opposite the face-attachment portion so that a fastener area is defined, the first spacer having a pacer thickness;

one or more fasteners binding the sheets and the binding strip together, the one or more fasteners driven through the fastener area and extending a head thickness above the face-attachment portion and a foot thickness below the back sheet, a fastener-foot area being defined on the back sheet:

wherein the first spacer thickness is at least as large as the head thickness, the spine-alignment edge of the binding strip and the spine edges of the sheets are substantially aligned, and the wraparound portion is bent so that the adhesive layer is in contact with the back sheet farther from the spine edge of the back sheet than the fastener-foot area wherein the fastener-foot area extends closer to the free edge than to the border, the bound document further including a second spacer having a second spacer thickness affixed to the interior surface adjacent to the fastener-foot area.

8. The bound document according to claim 7, wherein the second spacer extends substantially parallel to the border over substantially all of a length of the back sheet in the direction of extent of the border.

9. The bound document according to claim 7, further including one or more additional spacer(s) affixed to the back sheet adjacent to the fastener-foot area, the second spacer and each of the one or more additional spacer(s) covering a respective one of a plurality of disconnected sub-areas separated by boundaries extending substantially perpendicular to the border.

10. The bound document according to claim 9, wherein at least one of the second spacer or one or more additional spacer(s) is affixed to the back sheet so a portion thereof crosses the spine edge of the back sheet.

11. A bound document having a front sheet, a back sheet, and one or more interior sheet(s), each sheet having a spine edge, the bound document comprising:

a binding strip having:

a flexible substrate having an interior surface and an exterior surface, a spine-alignment edge, a free edge opposite the spine-alignment edge and substantially non-perpendicular thereto, a face-attachment portion of the exterior surface adjacent to the spine-alignment edge, and a wraparound portion of the interior surface adjacent to the free edge, wherein a border is defined laterally between the face-attachment portion and the wraparound portion and substantially parallel to the spine-alignment edge;

an adhesive layer arranged over the wraparound portion; and a first spacer affixed to the interior surface opposite the face-attachment portion so that a fastener area is defined, the first spacer having a spacer thickness;

one or more fasteners binding the sheets and the binding strip together, the one or more fasteners driven through the fastener area and extending a head thickness above the face-attachment portion and a foot thickness below the back sheet, a fastener-foot area being defined on the back sheet;

wherein the first spacer thickness is at least the head thickness, the spine-alignment edge of the binding strip and the spine edges of the sheets are substantially aligned, and the wraparound portion is bent so that the adhesive layer is in contact with the back sheet farther from the spine edge of the back sheet than the fastener-foot area further including a second spacer affixed to the back sheet farther from the spine edge of the back sheet than the fastener-foot area, the second spacer having a second thickness at least the foot thickness, wherein the wraparound portion is bent so that the adhesive layer is in contact with the second spacer.

12. The bound document according to claim 11, further including a third spacer affixed to the back sheet opposite the fastener-foot area from the second spacer.

13. The bound document according to claim 12, wherein, of the second and the third spacers, the thickness of the spacer laterally closer to the free edge is less than the thickness of the spacer laterally farther from the free edge.

14. The bound document according to claim 12, wherein the adhesive layer contacts the back sheet farther from the spine edge of the back sheet than the second spacer.

* * * * *